US005592862A

United States Patent [19]

Macor

[11] Patent Number: 5,592,862

[45] Date of Patent: Jan. 14, 1997

[54] COMPACT, HIGH TORQUE, MULTI-DRIVE SCREWDRIVER

[75] Inventor: Richard J. Macor, Greenwich Township, Warren County, N.J.

[73] Assignee: Proprietary Technologies, Inc.

[21] Appl. No.: 523,355

[22] Filed: Sep. 5, 1995

Related U.S. Application Data

[63] Continuation-in-part of Ser. No. 39,726, Jun. 5, 1995.

[51] Int. Cl.[6] ..... B25B 23/00

[52] U.S. Cl. ..... 81/439; 81/177.4; 81/490

[58] Field of Search ..... 81/177.1, 177.4, 81/438, 439, 489, 490

[56] References Cited

U.S. PATENT DOCUMENTS 5,421,225 6/1995 Chen ..... 81/177.4 X
5,442,982 8/1995 Bell ..... 81/490 X

*Primary Examiner*—James G. Smith

[57] ABSTRACT

A screwdriver is described having two double-ended driving bits, each having dimensions of length greater than width and a driving head at either end capable of controlling fastener rotation. The screwdriver also has a handle with dimensions of length greater than width, and width greater than thickness forming a somewhat flat handle that is appropriate for pocket storage and transportation. Extending out from the screwdriver handle is a screwdriver shank that is positioned to the side and off-center relative to the handle width to increase leverage and torque capabilities while maintaining a compact design. One of the two double-ended driving bits is stored within the handle while the other is temporarily held and secured within the screwdriver shank with one head exposed for fastener engagement. The components and their arrangement combine to form the present invention, a compact, high torque, four way multi-drive screwdriver that is user-friendly and cost efficient for manufacturing. In one preferred embodiment, the screwdriver has four different driving heads.

10 Claims, 2 Drawing Sheets

FIG 5
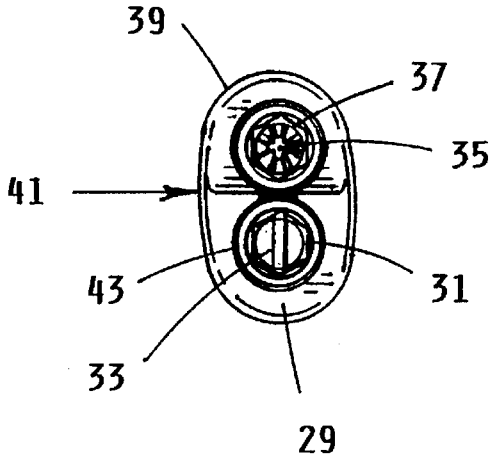
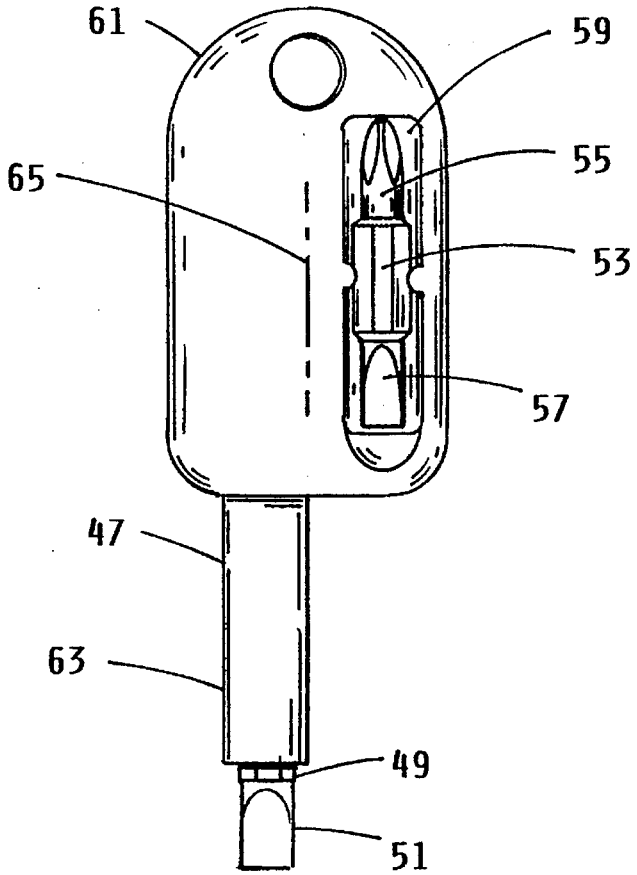
FIG 6

COMPACT, HIGH TORQUE, MULTI-DRIVE SCREWDRIVER

REFERENCES TO RELATED APPLICATIONS

This application is a Continuation-in-Part of U.S. design patent application Ser. No. 29/039,726, filed on Jun. 5, 1995, by the inventor herein.

BACKGROUND OF THE INVENTION

Field of the Invention

The present invention relates to tools, particularly screwdrivers, and most particularly screwdrivers having multiple driving heads. The present invention features a screwdriver having two double-ended driving bits, a handle and screwdriver shank. Each component of the present invention is arranged and positioned at a specific relationship to the other components therein. The components and their arrangement combine to form the present invention, a compact, high torque, four way multi-drive screwdriver that is user-friendly, and cost-efficient for manufacturing.

SUMMARY OF THE INVENTION

The present invention involves a screwdriver having two double-ended driving bits, each having dimensions of length greater than width, and a driving head at either end capable of controlling fastener rotation. The present invention also has a handle with dimensions of length greater than width, and width greater than thickness, forming a somewhat flat handle that is appropriate for pocket storage and transportation. Extending out from the handle is a screwdriver shank that is positioned to the side and off-center relative to the handle width, to increase leverage and torque capabilities while maintaining a compact design. One of the two double-ended driving bits is stored within the handle, while the other is temporarily held and secured within the screwdriver shank with one driving head extending out for fastener engagement. The two double-ended driving bits may be interchanged, and either end of either driving bit inserted into the screwdriver shank for use thereof. The arrangement of two interchangeable double-ended driving bits, provides one tool with the possibility of four different driving heads. The components and their arrangement combine to form the present invention, a compact, high torque, four way multi-drive screwdriver that is user-friendly, and cost-efficient for manufacturing.

BRIEF DESCRIPTION OF THE DRAWINGS

The present invention as described in this specification will be more fully understood when taken in conjunction with the drawings appended hereto, wherein:

FIG. 2, 3, 4 and 5 show a present invention compact, high torque, multi-drive screwdriver in front, side, rear and bottom views respectively.

FIG. 6 shows a side view of another present invention compact, high torque, multi-drive screwdriver.

DETAILED DESCRIPTION OF DRAWINGS

The present invention is directed towards a compact screwdriver having multiple driving heads with consideration for user ergonomics and manufacturing costs. The basic components of the present invention are two double-ended driver bits, a handle, and a shank. The combination and the arrangement thereof, form a screwdriver that is particularly effective and efficient in design. It is important to emphasize that a screwdriver having four single-ended driving bits shall not be considered the same, because four separate, single-ended driving bits necessitate additional and different storage requirements, and increased user labor when interchanging bits.

It is an object of the present invention to provide a screwdriver that has a compact pocket size, enhanced torque characteristics, and four driving heads via two double-ended driving bits for labor-efficient bit changing.

Figure 1:
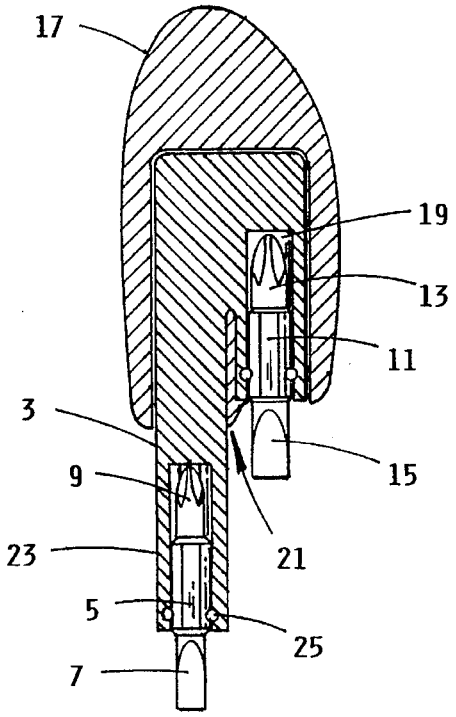
FIG. 1 shows a side, cross-section view of the present invention compact, high torque, multi-drive screwdriver.
Figure 2:
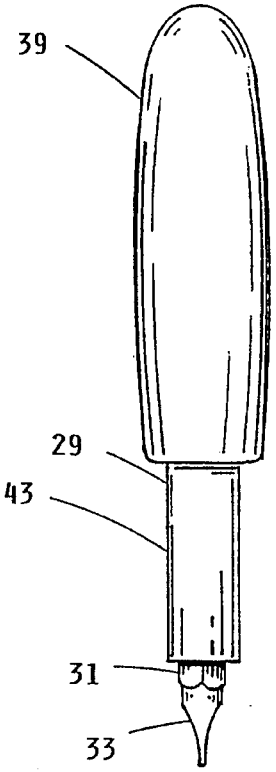

Referring now to FIG. 1, there is shown a side, cross-section view of a present invention screwdriver 3 having two double-ended driving bits 5 and 11. Both double-ended driving bits have dimensions of length greater then width. Double ended driving bit 5 is positioned within screwdriver shank 23, which extends off-center and down from elongated screwdriver handle 17. Screwdriver handle 17 has dimensions of length greater than width and width greater than thickness. Double ended driving bit 11 is stored within handle cavity 19 with the length of driving bit 11 substantially parallel to the length of handle 17, and off-center relative to center point 21, of handle 17 width. Double ended driving bit 5 has flat style driving head 7, and phillips style driving head 9, and is temporarily secured by spring ring 25 within shank 23. Flat style driving head 7 extends out of shank 23 for fastener engagement while phillips style driving head 9 is stored within. Double-ended driving bit 11 has flat style driving head 15, and phillips style, driving head 13. Note that each driving bit has two driving heads, each capable of controlling fastener rotation. The driving heads on double-ended driving bit 11 are larger in size than the driving heads on double-ended driving bit 5, providing screwdriver 3 with four different driving heads. It is important to note that the efficient design of the present invention is compromised by adding to or subtracting from the two double-ended driving bits.

Figure 3:
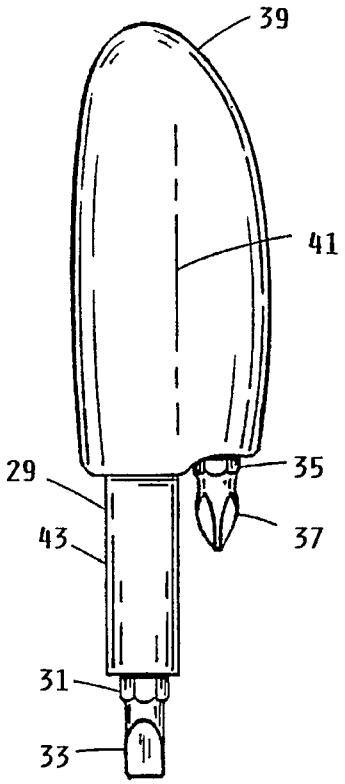
Figure 4:
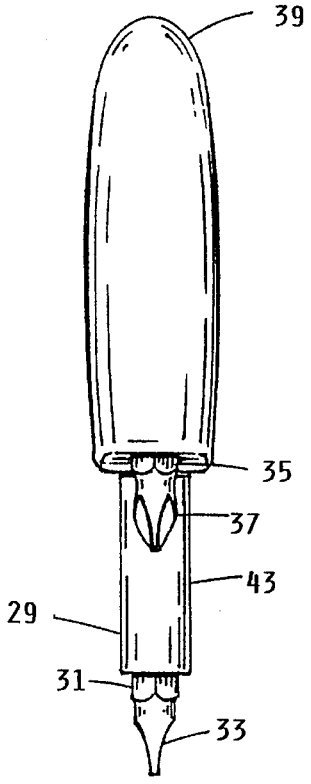

Referring now to FIGS. 2, 3, 4 and 5, there is a present invention compact, high torque, multi-drive screwdriver shown in front, side, rear and bottom views respectively. Screwdriver 29 is shown with two double-ended driving bits 31 and 35, each having dimensions of length greater than width. Double ended driving bit 31 has flat style head 33 exposed for fastener engagement and another smaller flat style head at the other end that is within screwdriver shank 43 and therefore not visible. Double-ended driving bit 35 has a phillips style head 37 exposed for user access, and a smaller phillips style head at the other end that is within screwdriver handle 39 and therefore not visible. Note that handle 39 has dimensions of length greater than width as shown in FIG. 3, and width greater than thickness as shown in FIG. 5. Double-ended driving bit 35 is stored within a cavity of handle 39 and positioned such that the length of driving bit 35 is substantially parallel to the length of handle 39, and off-center relative to center line 41 of the handle width as shown in FIG. 3. One double-ended driving bit stored and positioned this way within the handle is considered desirable to maintain a compact, ergonomic design. The driving head style is not as relevant herein as the driving bit. Preferred embodiments of the present invention utilize two double-ended driving bits comprising four driving heads. One bit is stored within the handle, and the other within the shank for immediate use. Screwdriver shank 43 extends out from handle 39 beside double-ended bit 35 and off-center relative to the handle width. Arranging shank 43 in this manner provides increased leverage and torque capabilities while maintaining a compact design. The components of this screwdriver and their arrangement combine to form the present invention, a compact, high torque, four way multi-drive screwdriver that is user-friendly, and cost-efficient for manufacturing. Furthermore, the screwdriver shape and design promote pocket storage and transportation with or without a carry-case or pouch.

In FIG. 6 screwdriver 47 is shown with two double-ended driving bits 49 and 53. Driving bit 49 has flat style head 51, and a phillips style head within shank 63, therefore not visible. Driving bit 53 has flat style head 57 and phillips style head 55 shown stored within handle cavity 59 of handle 61. Note that handle 61 and driving bit 53 both have dimensions of length greater than width, and the length of driving bit 53 is substantially parallel to the length of handle 61, and off-center relative to handle width as shown with center line 65. In order to maintain a compact, ergonomic design the present invention stores one double-ended driving bit within the handle, parallel to and beside the shank extending out from the handle. This arrangement provides for a multi-drive screwdriver with four driving heads that is efficient and compact in design. A screwdriver having more or less than two double-ended driving bits or, having multiple, single-ended driving bits will necessitate a different arrangement and a larger size. Note that the present invention involves two double-ended driving bits each with a separate distinct axis that is substantially parallel to the other, with one bit stored in the handle, and the other stored and secured within the shank.

Obviously, numerous modifications and variations of the present invention are possible in light of the above teachings. It is therefore understood that within the scope of the appended claims, the invention may be practiced otherwise than as specifically described herein.

What is claimed:

1. A screwdriver having multiple driving heads comprising:

(a) Two double-ended driving bits, each having dimensions of length greater than width and a driving head at either end capable of controlling fastener rotation; and, (b) a handle having dimensions of length greater than width, and width greater than thickness; and a cavity to store one of said two double-ended driving bits therein, with the length of said driving bit substantially parallel the length of said handle, and off-center relative to said handle width; and, (c) a screwdriver shank extending from said handle beside said handle cavity and off-center relative to said handle width; and, said screwdriver shank having means to house and secure rotation of one of said two double-ended driving bits.

2. A screwdriver of claim 1 wherein said double-ended driving bit stored within said handle cavity, extends out from said handle to facilitate the removal and insertion thereof.

3. A screwdriver of claim 1 wherein said two, double-ended driving bits together comprise four driving heads; said driving heads being two different "Phillips" style heads and two different flat style heads.

4. A screwdriver having multiple driving heads comprising:

(a) Two double-ended driving bits, each having dimensions of length greater than width and a driving head at either end capable of controlling fastener rotation; and, (b) a handle having dimensions of length greater than width, and width greater than thickness such that said handle is not cylindrical; and, said handle having a cavity to store one of said two double-ended driving bits therein, with the length of said driving bit substantially parallel to the length of said handle, and off-center relative to said handle width; and, (c) a screwdriver shank fixed within and extending from said handle, beside said handle cavity and off-center relative to said handle width; and, said screwdriver shank having means to house and secure rotation of one of said two, double-ended driving bits.

5. A screwdriver of claim 4 wherein said one double-ended driving bit stored within said handle cavity, extends out from said handle to facilitate the removal and insertion thereof.

6. A screwdriver of claim 4 wherein said two, double-ended driving bits together comprise, two different size "Phillips" style heads, and two different size flat style heads.

7. A screwdriver having two double-ended driving bits each having an elongated dimension and a driving head at either end capable of controlling fastener rotation; and, an elongated handle with dimensions of length greater than width, and width greater than thickness, and a cavity to store one of said two double-ended driving bits therein with the elongated dimension of said driving bit substantially parallel to the elongated dimension of said handle and off-center relative to said handle width; and, an elongated screwdriver shank fixed within and extending from said handle with the elongated dimension of said screwdriver shank substantially parallel to the elongated dimension of said handle and off-center relative to said handle width, and, said screwdriver shank having means to hold and secure the other one of said two double-ended driving bits for fastener engagement.

8. A screwdriver of claim 7 wherein said one double-ended driving bit stored within said handle cavity, extends out from said handle to facilitate the removal and insertion thereof.

9. A screwdriver of claim 7 wherein said two, double-ended driving bits together comprise, two different size "Phillips" style heads, and two different size flat style heads.

10. A screwdriver having multiple driving heads comprising:

(a) At least two double-ended driving bits, each having dimensions of length greater than width and a driving head at either end capable of controlling fastener rotation; and, (b) a handle having dimensions of length greater than width, and width greater than thickness; and a cavity to store at least one of said at least two double-ended driving bits therein, with the length of each said driving bit substantially parallel to the length of said handle and off-center relative to said handle width; and, (c) a screwdriver shank extending from said handle beside said handle cavity and off-center relative to said handle width; and, said screwdriver shank having means to house and secure rotation of at least one of said at least two double-ended driving bits.

* * * * *